US009352873B2

(12) United States Patent
Dorn

(10) Patent No.: US 9,352,873 B2
(45) Date of Patent: May 31, 2016

(54) PLASTIC CONTAINER CONFIGURED FOR CASE-LESS SHIPPING

(75) Inventor: James Christopher Dorn, Sterling, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 12/855,902

(22) Filed: Aug. 13, 2010

(65) Prior Publication Data

US 2011/0132863 A1 Jun. 9, 2011

Related U.S. Application Data

(63) Continuation-in-part of application No. 29/351,360, filed on Dec. 4, 2009, now Pat. No. Des. 662,421.

(51) Int. Cl.

| | |
|---|---|
| ***B65D 21/00*** | (2006.01) |
| ***B65D 1/02*** | (2006.01) |
| ***B65D 21/02*** | (2006.01) |
| ***B65D 23/10*** | (2006.01) |

(52) U.S. Cl.

CPC ..... *B65D 1/0223* (2013.01); *B65D 21/0209* (2013.01); *B65D 23/10* (2013.01); *B65D 2501/0036* (2013.01); *B65D 2501/0081* (2013.01)

(58) Field of Classification Search

CPC ..... B65D 21/0231; B65D 21/0202; B65D 21/0204; B65D 21/0237; A47G 19/23

USPC ..... 215/10, 382, 900, 1 C; 220/403, 666, 8; 222/212, 215, 92, 210

See application file for complete search history.

(56) References Cited

U.S. PATENT DOCUMENTS

| | | | | | |
|---|---|---|---|---|---|
| 3,172,577 | A | * | 3/1965 | Hartung | 222/206 |
| D211,506 | S | * | 6/1968 | Anderson | D9/528 |
| 3,484,019 | A | * | 12/1969 | Hirota | 206/174 |
| 3,589,553 | A | * | 6/1971 | Culver et al. | 206/172 |
| 4,368,826 | A | * | 1/1983 | Thompson | 215/398 |
| 4,372,455 | A | * | 2/1983 | Cochran | B29C 49/0073 215/385 |
| 4,412,633 | A | | 11/1983 | Guerrazzi et al. | |
| 4,733,804 | A | * | 3/1988 | Slat | B65D 1/44 220/675 |
| 4,805,793 | A | | 2/1989 | Brandt et al. | |

(Continued)

OTHER PUBLICATIONS

USPTO, International Search Report and Written Opinion issued in corresponding PCT Application No. PCT/US2011/047401, filed Aug. 11, 2011. Date of Mailing: Jan. 6, 2012.

*Primary Examiner* — Fenn Mathew
*Assistant Examiner* — Cynthia Collado
(74) *Attorney, Agent, or Firm* — Dykema Gossett PLLC

(57) ABSTRACT

A plastic container configured for case-less shipping includes a base portion, a sidewall portion, and a neck portion. The base portion is configured to support the container on a surface and includes a substantially planar surface contact portion. The sidewall portion extends upwardly from the base portion and includes a shoulder, an integrally molded handle having a handle opening, and a horizontally-extending collapsible formation. The neck portion extends upwardly from the shoulder of the sidewall portion and includes a dispensing opening, a neck finish, and an uppermost vertical portion. In an embodiment, the handle includes a handle portion that extends vertically from the sidewall portion to an extent that is at or about the same vertical height as the uppermost vertical portion of the neck portion, and a portion of the sidewall portion is permitted to deform in response to a top load force.

24 Claims, 9 Drawing Sheets

(56) References Cited

U.S. PATENT DOCUMENTS

| | | | | |
|---|---|---|---|---|
| 4,854,575 | A * | 8/1989 | Wilson et al. | 482/108 |
| 5,002,199 | A | 3/1991 | Frahm | |
| 5,206,037 | A * | 4/1993 | Robbins, III | B29C 53/08 264/295 |
| 6,068,161 | A | 5/2000 | Soehnlen et al. | |
| 6,588,612 | B1 | 7/2003 | Dorn et al. | |
| 6,896,147 | B2 | 5/2005 | Trude | |
| 6,932,228 | B1 | 8/2005 | Darr et al. | |
| 7,059,487 | B2 * | 6/2006 | Ohlsson | B65D 1/0292 215/381 |
| 7,467,714 | B2 | 12/2008 | Slat et al. | |
| D587,126 | S | 2/2009 | DeSico et al. | |
| 2003/0010743 | A1 | 1/2003 | Boukobza | |
| 2008/0035637 | A1 | 2/2008 | Shehadey et al. | |
| 2009/0026216 | A1 * | 1/2009 | Philpott | 220/666 |
| 2011/0132790 | A1 * | 6/2011 | Dorn | 206/509 |

* cited by examiner

PLASTIC CONTAINER CONFIGURED FOR CASE-LESS SHIPPING

CROSS-REFERENCE TO RELATED APPLICATION

This application is a continuation-in-part of U.S. Design patent application Ser. No. 29/351,360, filed Dec. 4, 2009, now pending, which is hereby incorporated by reference in its entirety as though fully set forth herein.

TECHNICAL FIELD

The present disclosure relates generally to plastic containers that are configured for case-less shipping.

BACKGROUND

Plastic containers are used for storing a wide variety of contents. Such containers are commonly stored and shipped in bulk in some form of shipping case. The shipping case can, among other things, remove some of the burden associated with the stackability and structural loading of the containers being shipped. Some examples of shipping cases include cardboard or corrugated boxes and plastic cases.

There are, however, added costs and potential inefficiencies associated with providing and using various types of cases in connection with the packaging and shipping of plastic containers.

SUMMARY

A plastic container configured for case-less shipping is disclosed. Embodiments of the container include a base portion, a sidewall portion, and a neck portion. The base portion is configured to support the container on a surface and includes a substantially planar surface contact portion. The sidewall portion extends upwardly from the base portion and includes a shoulder, an integrally molded handle having a handle opening, and a horizontally-extending collapsible formation. The neck portion extends upwardly from the shoulder of the sidewall portion and includes a dispensing opening, a neck finish, and an uppermost vertical portion. In an embodiment, the handle includes a handle portion that extends vertically from the sidewall portion to an extent that is at or about the same vertical height as the uppermost vertical portion of the neck portion, and a portion of the sidewall portion is permitted to deform in response to a top load force.

BRIEF DESCRIPTION OF THE DRAWINGS

Embodiments of the invention will now be described, by way of example, with reference to the accompanying drawings, wherein.

DETAILED DESCRIPTION

Reference will now be made in detail to embodiments of the present invention, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
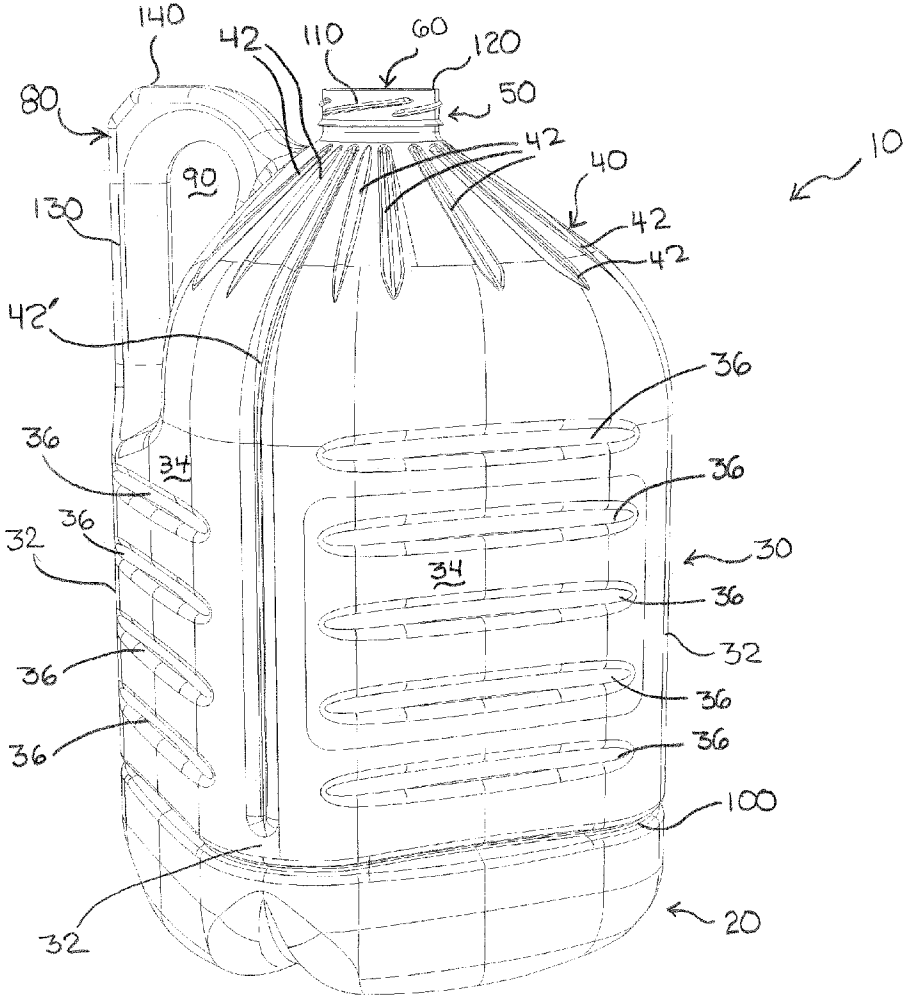
FIG. 1 is an isometric view of an embodiment of a container embodying aspects of the present invention.

An isometric view of an embodiment of a container 10 exhibiting aspects of the teachings of the present invention is generally shown in FIG. 1. The illustrated container 10 generally includes a closed base portion 20; a sidewall portion 30, including a shoulder 40; a neck portion 50; and a dispensing opening 60. Various other views of the container 10 are shown in FIGS. 2-7.

Figure 7:
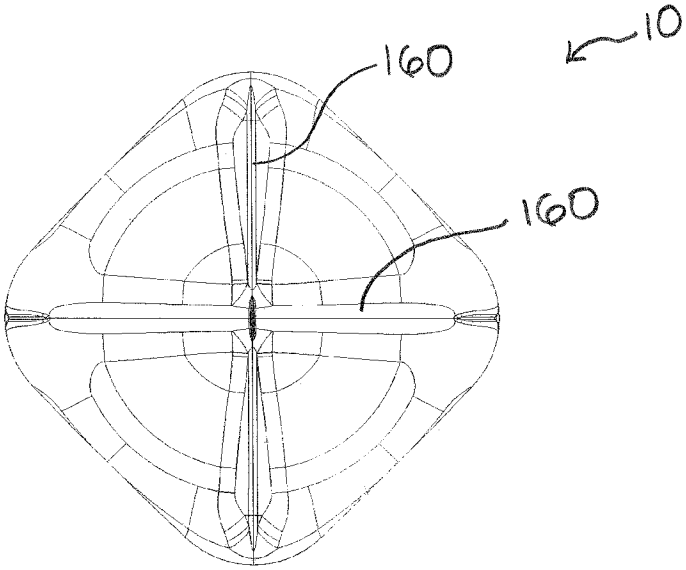
FIG. 7 is a bottom view of the container shown in FIG. 1.

The base portion 20 may be configured to support the container on a surface, which may comprise a substantially planar support surface. As generally depicted in FIGS. 2-5, in embodiments, the base portion 20 may include a substantially planar surface contact portion (see, e.g., contact portion 70 generally shown in FIG. 2). The use of a substantially planar base portion 20 can help to distribute a top load over a larger area, which can help to reduce bottle deformation when a container experiences top loading. With reference to FIG. 7, an embodiment of the invention may provide a base portion 20 that provides a generally square footprint (which may include rounded (as shown) or chamfered corners).

The sidewall portion 30 generally extends upwardly from the base portion 20, and includes a shoulder 40. In embodiments, the sidewall portion 30 may include an integrally molded handle 80. The handle 80 may be provided substantially in just the upper one-half of the container 10 and/or the outer radial extent of the handle 80 may be configured such that the handle does not extend radially beyond the outer radial extent of the sidewall portion 30 of the container 10. The handle 80 may be blow molded and generally hollow, and may include a handle opening 90. Further, the handle 80 and handle opening 90 may be configured to permit a portion of a user's hand to extend into or through the opening 90 to facilitate gripping and/or pouring. It is additionally noted that the shape of the opening 90 may be configured to help limit the expansion of the sidewall portion 30 into the opening 90 when the container experiences top loading.

The sidewall portion 30 may further include a horizontally-extending collapsible formation, such as collapsible rib 100. Moreover, in embodiments, a portion of the sidewall portion 30—which may comprise a horizontally-extending collapsible formation (such as generally illustrated as collapsible rib 100)—may be permitted to deform, at least in part, in response to a top load force (e.g., the weight of other containers that are stacked above). In embodiments, the horizontally-extending collapsible formation extends across or substantially across a side of the container. The horizontally-extending collapsible formation may be configured to serve as a form of "shock absorber" with respect to anticipated top load forces (such as incurred with the weight of containers stacked above). The use of a horizontally-extending collapsible formation can serve to help reduce container unwanted/unanticipated deformation by permitting deformation in one or more specific locations that do not reduce the top load. For instance, a collapsing rib may allow a filled container to reach a hydrostatic equilibrium without exceeding the plastic deformation of the container. Further, with respect to some embodiments, the horizontally-extending collapsible formation may extend continuously around the periphery of the container. The sidewall portion 30 may also include edges 32 that extend vertically and separate panel portions (generally indicated as 34 in the illustrated container 10). If desired, the horizontally-extending collapsible formation may have a different cross sectional shape at or about the edges 32 of the container (see e.g. FIG. 2, where the horizontally-extending collapsible formation (collapsible rib 100) is more narrow (in the vertical direction) at the edges 32 and is wider through the separated panel portions 34. Again, as desired, the horizontally-extending collapsible formation may be configured to deform in response to top-loading of the container. The sidewall portion 30 may further include one or more panel reinforcement formations configured to provide at least some structural support to the sidewall portion 30 of the container 10. In the illustrated embodiment, the panel reinforcement formations comprise a plurality of horizontally extending rib-like formations 36. However, it is noted the invention is not limited to a specific form of panel reinforcement formation and various other types of panel reinforcements may be employed in lieu of, or in addition to, the depicted formations.

Figure 2:
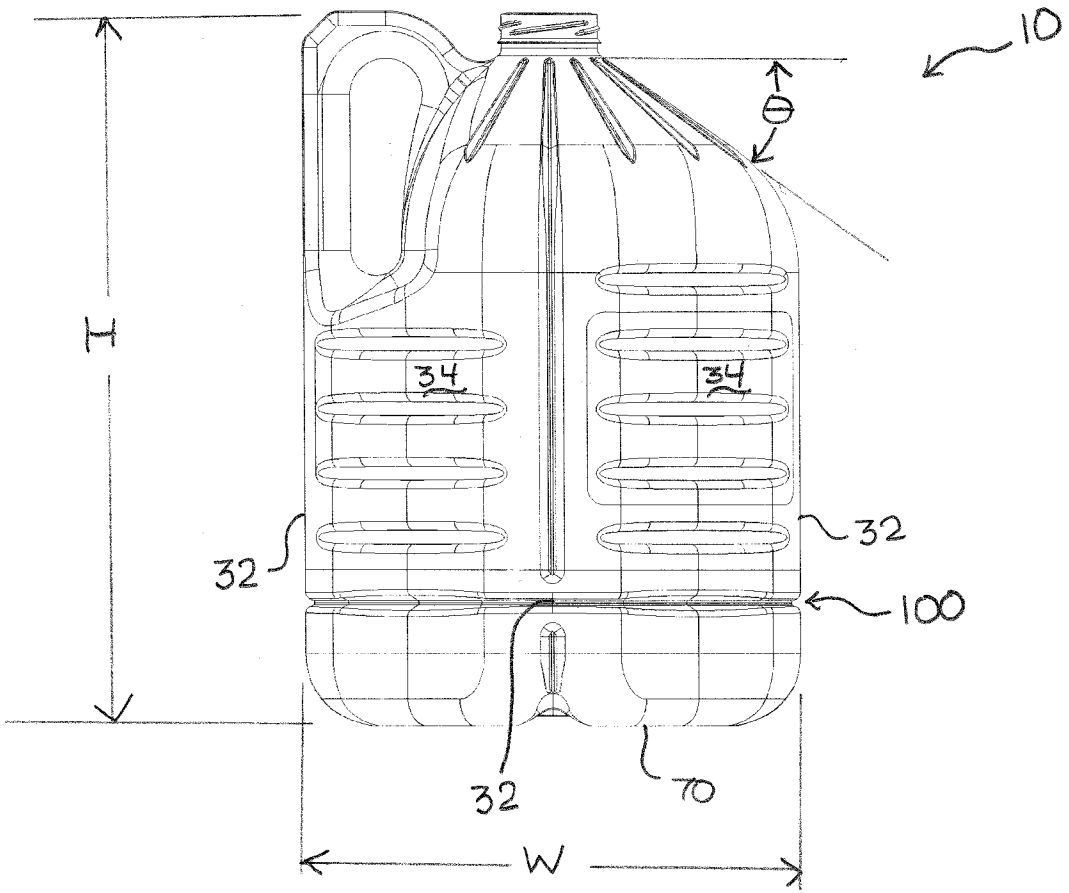
FIG. 2 is a left side elevation view of the container shown in FIG. 1.
Figure 3:
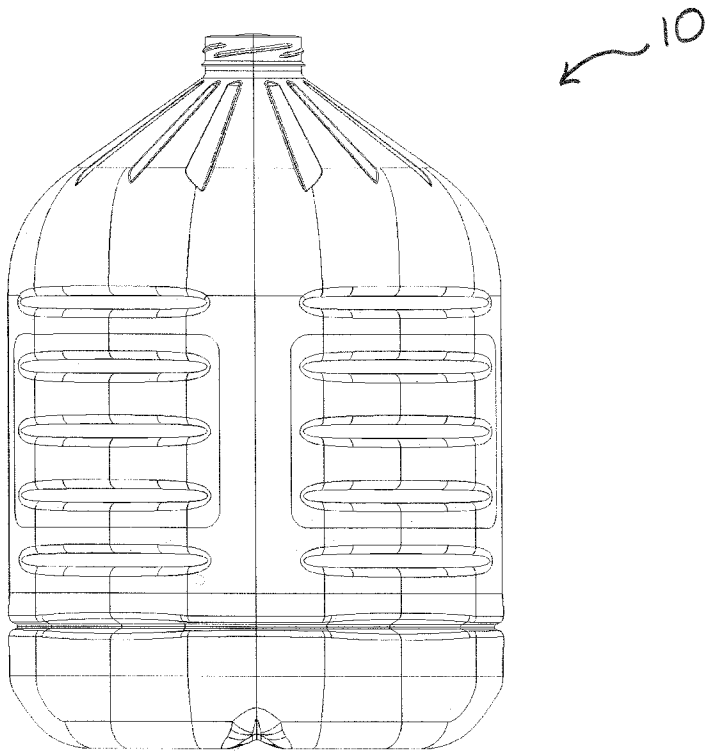
FIG. 3 is a front elevation view of the container shown in FIG. 1.
Figure 4:
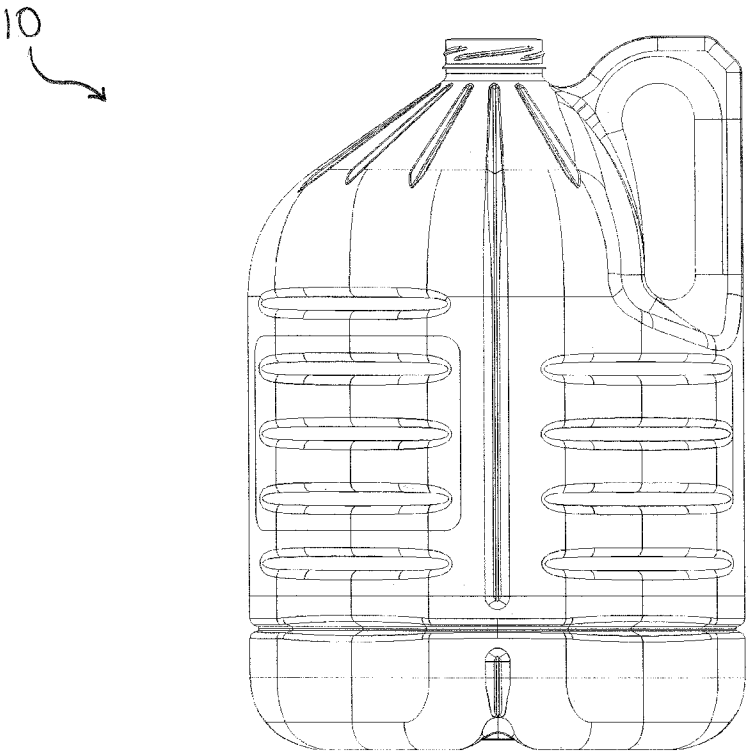
FIG. 4 is a right side elevation view of the container shown in FIG. 1.
Figure 5:
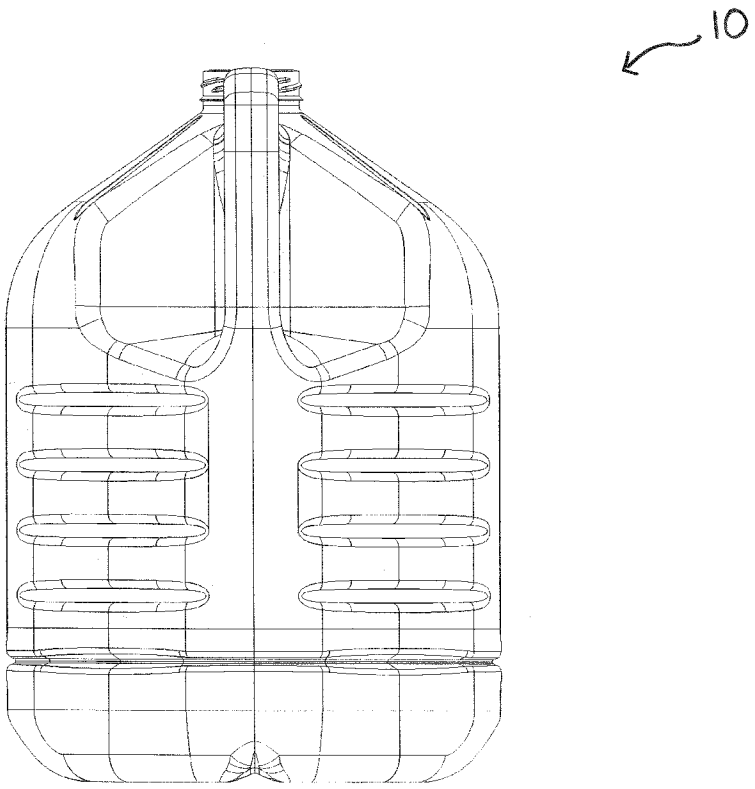
FIG. 5 is a rear elevation view of the container shown in FIG. 1.
Figure 6:
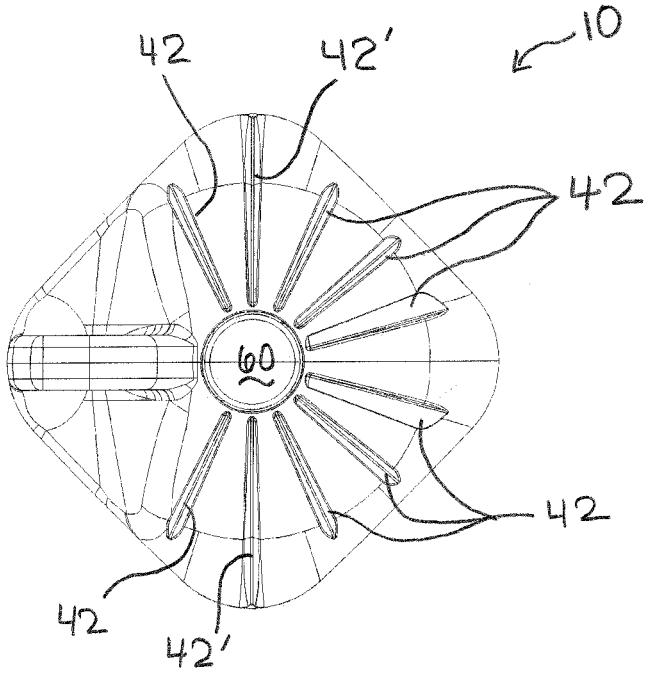
FIG. 6 is a top plan view of the container shown in FIG. 1.

The shoulder 40 extends to the neck portion 50 at an angle (e.g., angle .theta. generally depicted in FIG. 2). The angle may, by way of example, range from about 30.degree. to about 45.degree. In an exemplary embodiment the angle may be about 40.degree.+−.5.degree. In embodiments, with the exception of a portion of the shoulder 40 that is associated with, or connects to, the handle 80, the angle of the shoulder 40 may be substantially consistent around the circumference of the sidewall portion 30. In embodiments, the shoulder 40 may include a plurality of reinforcement formations that, among other things, may be configured to provide structural support to the shoulder 40. For example, without limitation, the reinforcement formations may comprise a plurality of radially extending ribs 42. The radially extending ribs 42 may be wedge-shaped or angularly-shaped, and may vary in width (e.g., may be more narrow at one or both ends), such as generally illustrated. In an embodiment, each reinforcement formation may extend downwardly (and radially outwardly) from a position substantially adjacent the neck portion 50. If desired, such formations may extend (e.g., as shown in FIG. 6) substantially to the outer perimeter of the container (as such perimeter is viewed in the plan view for the container 10). Further, optionally, the container may include one or more longer radially extending ribs 42' that extend from downwardly into the sidewall portion 30, and may extend a substantial vertical distance along the sidewall portion 30 of the container 10. For example, without limitation, in the illustrated embodiment two longer radially extending ribs 42' extend vertically downward along a significant vertical length of the sidewall portion 30. As shown, a plurality of longer radially extending ribs 42' may extend downwardly to a position adjacent a horizontally-extending collapsible formation (e.g., collapsible rib 100). The longer radially extending ribs 42' may be configured to provide stacking support strength so that the sidewall portion 30 of the container is more apt to "absorb" or direct top load forces to where such forces are intended to be accommodated—e.g., at or via a horizontally-extending collapsible formation (e.g., collapsible rib 100). Moreover, such longer radially extending ribs 42' may (for example, as illustrated in FIG. 6) be positioned at approximately 180.degree. relative to a central axis of a substantially centrally positioned dispensing opening 60 and may, as generally shown, run substantially along one or more (or even all) of the vertical edges or corners of the container.

Figure 8:
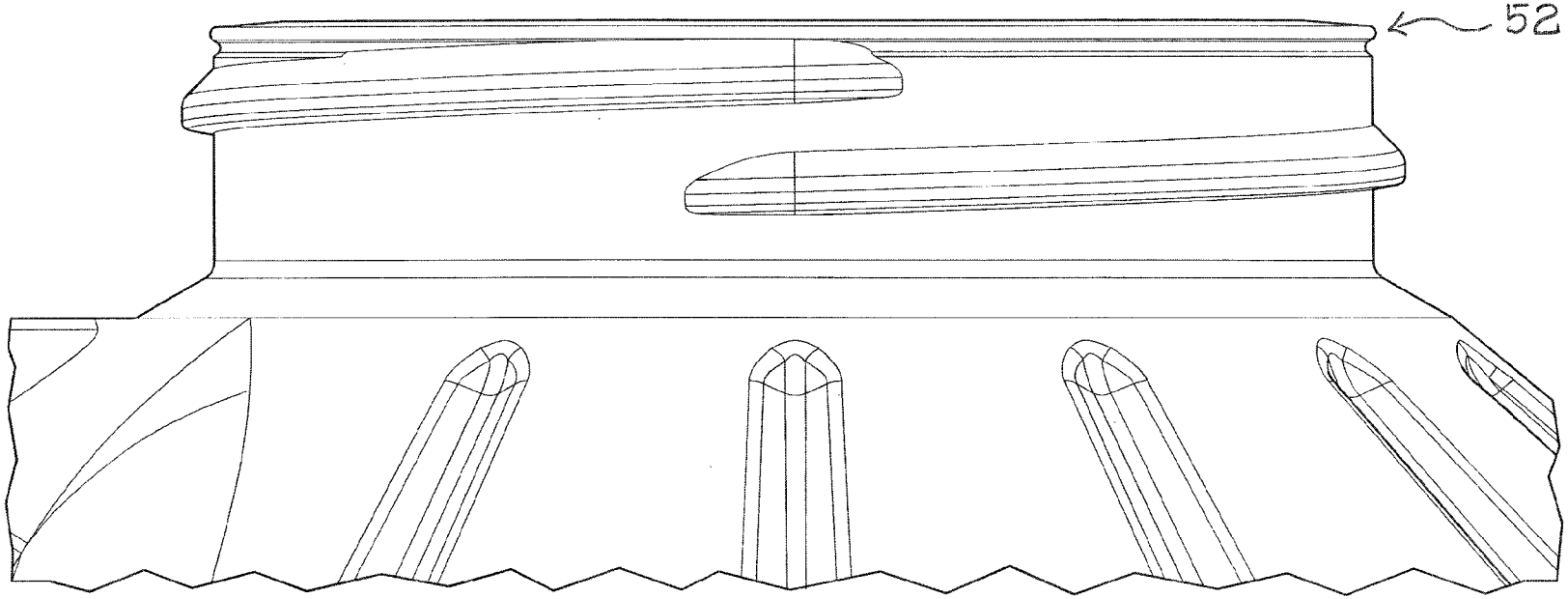
FIG. 8 is an enlarged partial view of a neck and shoulder of an exemplary container.
Figure 9:
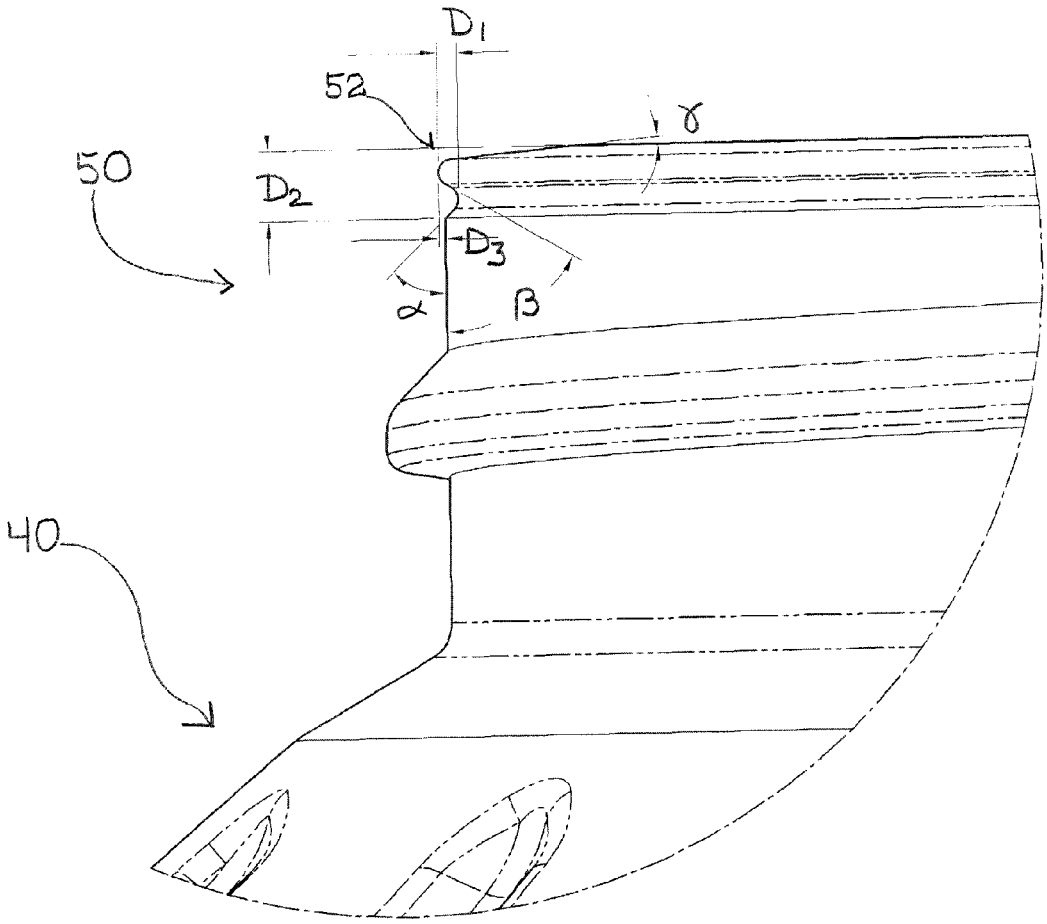
FIG. 9 is an enlarged partial view of a portion of a neck and shoulder.

The neck portion 50 generally extends upwardly from the shoulder 40, and includes a dispensing opening 60. In embodiments, the container 10 includes a central vertical axis, and the dispensing opening 60 is substantially centered on the central vertical axis. The neck portion 50 may further include a neck finish 110 (e.g., threads provided for engaging a closure (not shown)) and may have an uppermost vertical portion 120. As generally illustrated in the enlarged partial views shown in FIGS. 8 and 9, the neck portion 50 may include a drip lip 52. As generally shown in FIG. 9, depicted angles/slopes $\alpha$, $\beta$ and $\gamma$ associated with the drip lip 52 may be provided all the way around the circumference of the neck portion 50. For example, in embodiments, angle/slope $\alpha$ may be about 45°±5°, angle/slope $\beta$ may be about 60°±5°, and angle/slope $\gamma$ may be about 5°±5° The drip lip may additionally include certain intended offsets—generally illustrated in FIG. 9 as distances $D_1$, $D_2$, and $D_3$. In an embodiment, distance $D_1$ may be about 0.15±0.05 inches, distance $D_2$ may be about 0.53±0.05 inches, and distance $D_3$ may be about 0.005±0.004 inches. The use of a drip lip such as disclosed can, among other things, help keep the neck finish 110 and closure (not shown) free of product when contents are dispensed.

In embodiments, such as those generally illustrated, the handle 80 may include a handle portion 130 that extends vertically from the sidewall portion 30 to a vertical extent (at or about point 140) that is at or about the same vertical height as the uppermost vertical portion 120 of the neck portion 50. As such, the handle 80 can be configured so that the handle 80 will bear (i.e., help distribute) at least some weight or top load forces, such as those associated with the stacking of containers.

Referring to FIG. 7, it is noted that the base portion 20, while still substantially planar, may include one or more transverse formations 160. In embodiments, the base portion 20 may include at least two transverse formations that intersect one another and/or at least two transverse formations that are substantially perpendicular to each other.

Those of skill in the art will appreciate that the use of a horizontally-extending collapsible formation (e.g., collapsible rib) and a substantially planar bottom allows a container employing the disclosed teachings to convert a measure of hydrostatic pressure into a load bearing feature. For example, when such a container is filled, the deformation of a portion of the sidewall portion in response to a top load force may be countered, at least in part, by an internal hydrostatic force.

The container 10 may be comprised of a synthetic plastic material, such as for example, polyethylene (including high density polyethylene (HDPE)), polypropylene, polycarbonate, or polyethylene terephthalate (PET), or other plastic material or plastic materials in combination, including multilayer combinations. In embodiments, the container may, for example and without limitation, have a total height H of about 9.8±0.4 inches, a total width W of about 6.8±0.4 inches, may have an unfilled weight of about 70±4 grams, and may be configured to have a content volume of up to 128 fluid ounces, or more.

A method for case-less stacking of plastic containers is also disclosed. In an embodiment, a first level of plastic containers including features as generally disclosed is provided. A tier sheet, such as a cardboard sheet, may be provided upon the first level of containers. A second level of plastic containers may then be provided upon the tier sheet, the weight of the second level of plastic containers creating a top load force on the first level of plastic containers. The horizontally-extending collapsible formations of the first level of plastic containers may then deform in response to the top load force until the top load force is at least partially countered by an internal hydrostatic force associated with one or more of the first level of plastic containers. The method is, of course, not limited to a specific number of levels of containers.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims appended hereto and their equivalents.

What is claimed is:

1. A plastic container configured for case-less shipping, the container comprising:

a base portion configured to support the container on a surface, the base portion including a substantially planar surface contact portion;

a sidewall portion extending upwardly from the base portion, the sidewall portion including a shoulder, a generally hollow handle integrally blow molded with the container and having a handle opening, and a horizontally-extending collapsible formation; and a neck portion, the neck portion extending upwardly from the shoulder of the sidewall portion, the neck portion including a dispensing opening, a neck finish, and an uppermost vertical portion, and the dispensing opening is substantially centered on a central vertical axis of the container such that, in a top plan view, the dispensing opening is substantially positioned at the center of the top plan view;

wherein the handle includes a handle portion that extends vertically from the sidewall portion to an extent that is at or about the same vertical height as the uppermost vertical portion of the neck portion in order to support a portion of another container in a stacked configuration and bear at least some of a top load force created by the weight of the other container; a portion of the sidewall portion is permitted to deform in response to the top load force;

wherein the horizontally-extending collapsible formation is configured to deform in part without exceeding the plastic deformation of the container to reduce deformation of the container in response to the top load force.

2. The container of claim 1, wherein the horizontally-extending collapsible formation extends across a side of the container.

3. The container of claim 1, wherein the horizontally-extending collapsible formation extends continuously around the periphery of the container.

4. The container of claim 1, wherein the sidewall includes edges that separate panel portions, and the horizontally-extending collapsible formation is narrower in the vertical direction near the edges than through an intermediate portion of the separated panel portions.

5. The container of claim 1, wherein the horizontally-extending collapsible formation comprises a collapsible rib.

6. The container of claim 1, wherein the horizontally-extending collapsible formation is configured to deform in response to top-loading of the container.

7. The container of claim 1, wherein the shoulder extends to the neck portion at an angle.

8. The container of claim 7, wherein, with the exception of the portion of the shoulder that is associated with the handle, the angle of the shoulder is substantially the same around the circumference of the sidewall portion.

9. The container of claim 7, wherein the angle is from about 30° to about 40°.

10. The container of claim 7, wherein the angle is about 40°±5°.

11. The container of claim 1, wherein the shoulder includes a plurality of reinforcement formations.

12. The container of claim 1, wherein the shoulder includes a plurality of radially extending ribs.

13. The container of claim 1, wherein the handle opening extends vertically in a direction generally parallel with a longitudinal axis of the container, the handle opening defining a finger-receiving area.

14. The container of claim 1, wherein the handle is provided in the upper one-half of the container.

15. The container of claim 1, wherein the outer radial extent of the handle does not extend radially beyond the outer radial extent of the sidewall of the container.

16. The container of claim 1, wherein the neck finish includes a drip lip.

17. The container of claim 1, wherein the base portion includes a transverse formation.

18. The container of claim 1, wherein the base portion includes at least two transverse formations that intersect one another.

19. The container of claim 1, wherein the base portion includes at least two transverse formations, the at least two transverse formations being substantially perpendicular to each other.

20. The container of claim 1, wherein the sidewall portion further includes a plurality of horizontal ribs that extend substantially across the container.

21. The container of claim 1, wherein the container is essentially square.

22. The container of claim 1, wherein the dispensing opening is directly centered on the central vertical axis of the container.

23. The container of claim 1, wherein the horizontally-extending collapsible formation is configured to allow the container, when the container is filled, to reach a hydrostatic equilibrium without exceeding the plastic deformation of the container.

24. A method for case-less stacking of plastic containers, comprising:

providing a first level of plastic containers, each container having a base portion including a substantially planar surface contact portion; a sidewall portion extending upwardly from the base portion, the sidewall portion including a shoulder, an integrally molded handle having a handle opening, and a horizontally-extending collapsible formation; and a neck portion extending upwardly from the shoulder of the sidewall portion, the neck portion including a dispensing opening, a neck finish, and an uppermost vertical portion, wherein the dispensing opening is substantially centered on a central vertical axis of the container such that, in a top plan view, the dispensing opening is substantially positioned at the center of the top plan view; wherein the handle is generally hollow and is blow molded, and the handle includes a handle portion that extends vertically from the sidewall portion to an extent that is at or about the same vertical height as the uppermost vertical portion of the neck portion; wherein the horizontally-extending collapsible formation is configured to deform in part without exceeding the plastic deformation of the container to reduce deformation of the container in response to the top load force;

providing a tier sheet upon the first level of plastic containers;

providing a second level of plastic containers upon the tier sheet, wherein the weight of the second level of plastic containers creates the top load force on the first level of plastic containers, permitting the horizontally-extending collapsible formation of the first level of plastic containers to deform in response to the top load force until the top load force is at least partially countered by an internal hydrostatic force associated with one or more of the first level of plastic containers.

* * * * *